US005169567A

United States Patent [19]

Daugherty et al.

[11] Patent Number: 5,169,567

[45] Date of Patent: Dec. 8, 1992

[54] WATER AERATION APPARATUS

[76] Inventors: James J. Daugherty, 1726 SW. 18th St., Cape Coral, Fla. 33991; Paul E. Hampton, 4675 Riverside Dr., Estero, Fla. 33928

[21] Appl. No.: 770,442

[22] Filed: Oct. 3, 1991

[51] Int. Cl.[5] ..... B01F 3/04; B01F 5/20

[52] U.S. Cl. ..... 261/30; 261/124; 261/117; 210/220

[58] Field of Search ..... 261/30, 124, 117; 210/220

[56] References Cited

U.S. PATENT DOCUMENTS

| | | | |
|---|---|---|---|
| 1,047,534 | 12/1912 | Joseph | 210/220 |
| 1,877,046 | 9/1932 | Phillips | 261/124 |
| 1,980,499 | 11/1934 | Pfaff | 261/124 |
| 2,243,582 | 5/1941 | Soffe | 210/220 |
| 2,549,848 | 4/1951 | Otto | 261/117 |
| 2,568,875 | 9/1951 | Wethly et al. | 261/124 |
| 3,061,204 | 10/1962 | MacInnes et al. | 261/DIG. 11 |
| 3,772,187 | 11/1973 | Othmer | 210/220 |
| 4,086,308 | 4/1978 | Jurgens et al. | 261/124 |
| 4,130,612 | 12/1978 | Wilop | 261/91 |
| 4,298,467 | 11/1981 | Gartner et al. | 210/220 |
| 4,482,509 | 11/1984 | Iannelli | 261/124 |
| 4,842,732 | 6/1989 | Tharp | 261/122 |
| 4,943,305 | 7/1990 | Bernhardt | 55/170 |

FOREIGN PATENT DOCUMENTS

| | | | |
|---|---|---|---|
| 244250 | 12/1965 | Austria | 210/220 |

*Primary Examiner*—Tim Miles

*Attorney, Agent, or Firm*—Leon Gilden

[57] ABSTRACT

A reservoir is arranged to include a water inlet conduit and a water outlet conduit. The reservoir includes an aeration manifold effecting aeration of water contained within the reservoir, wherein the aeration manifold cooperates with a water dispersion manifold to enhance aeration of water directed into the reservoir. Various nozzle structure is mounted to the dispersion manifold to enhance aeration in a passive manner in association with the aeration manifold.

4 Claims, 5 Drawing Sheets

10
17
12
12a
19
2
2
3
3
16
11
4
4
14a
14
13
13a
15

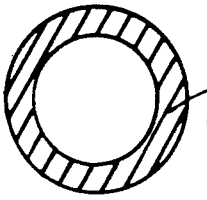
Fig 2
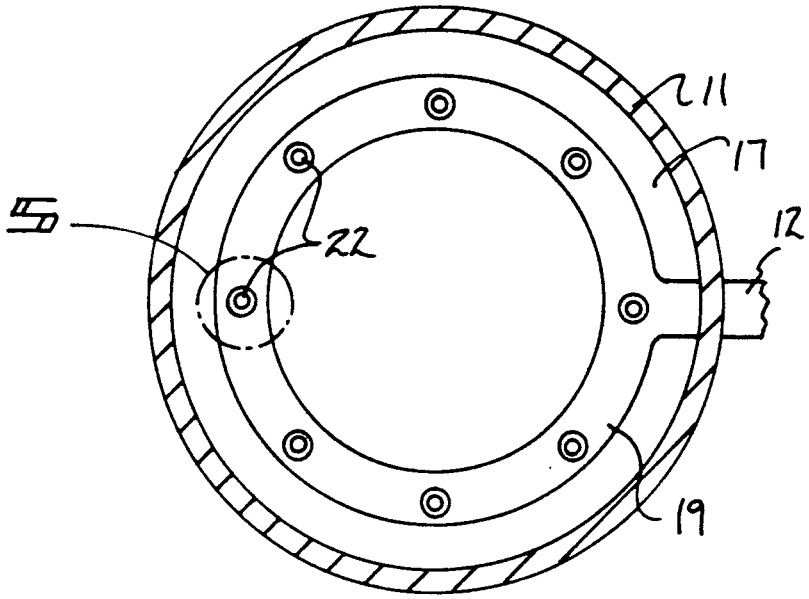
Fig 3
Fig 4
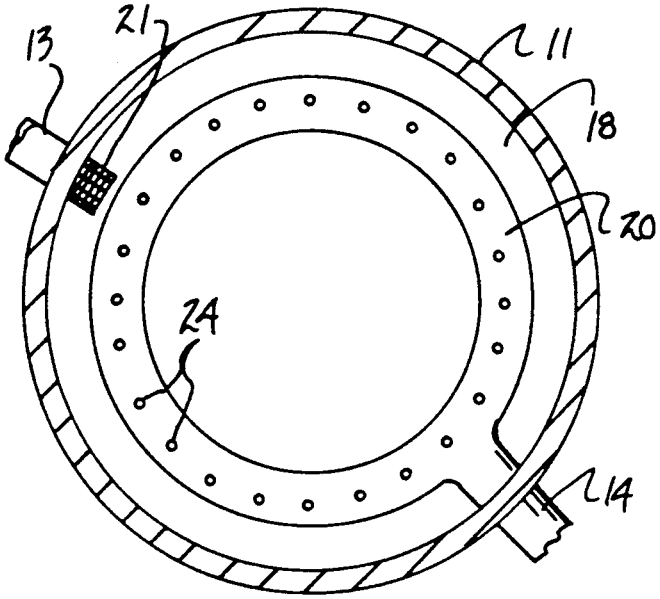

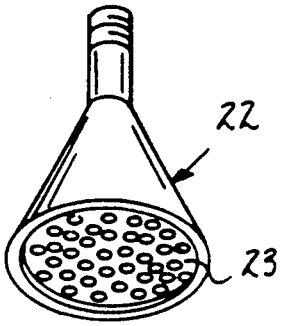
Fig 5
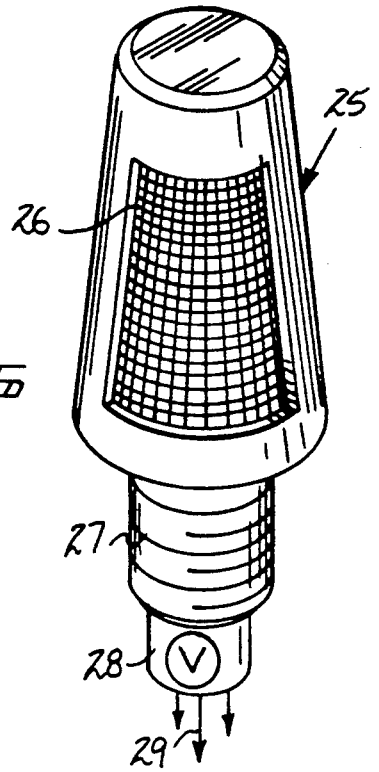
Fig 6
Fig 7
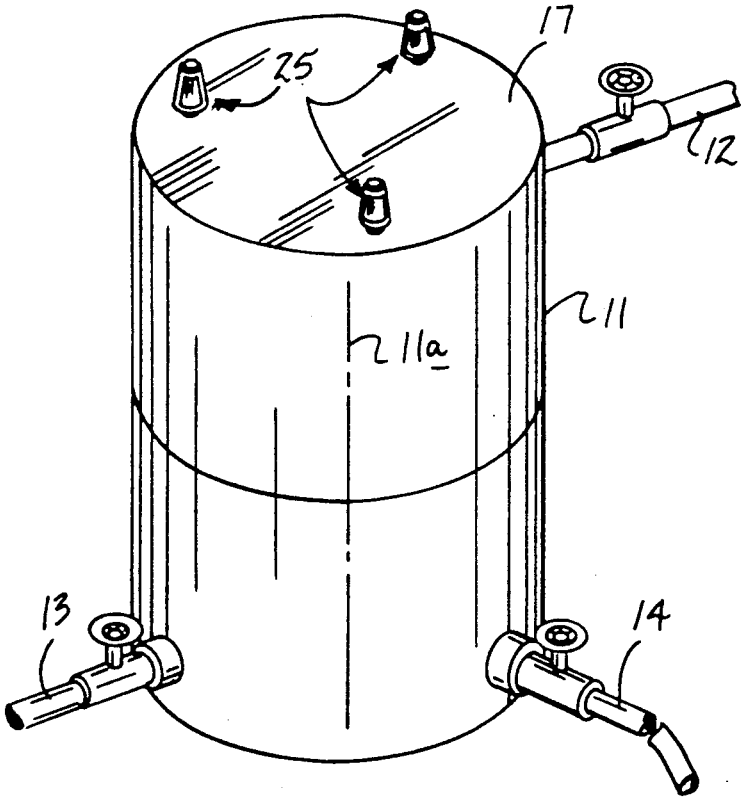

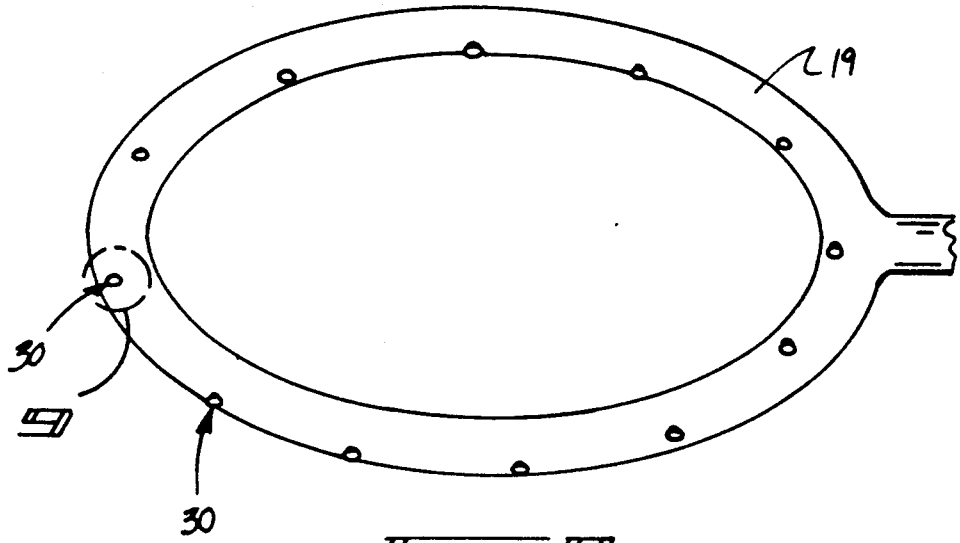
Fig 8B
Fig 9
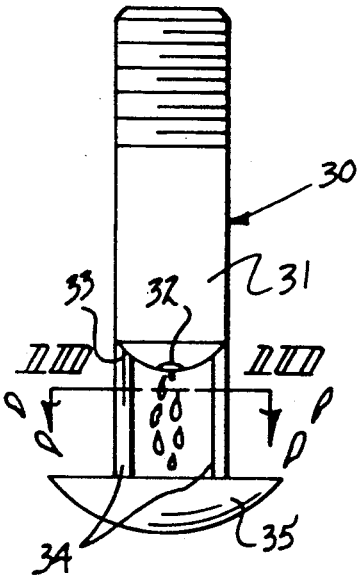
Fig 10
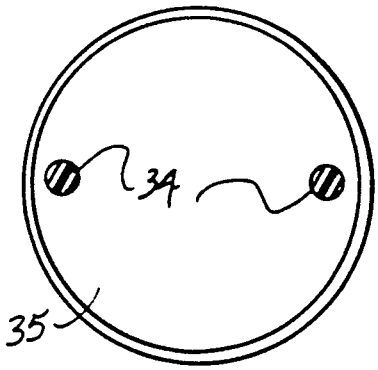

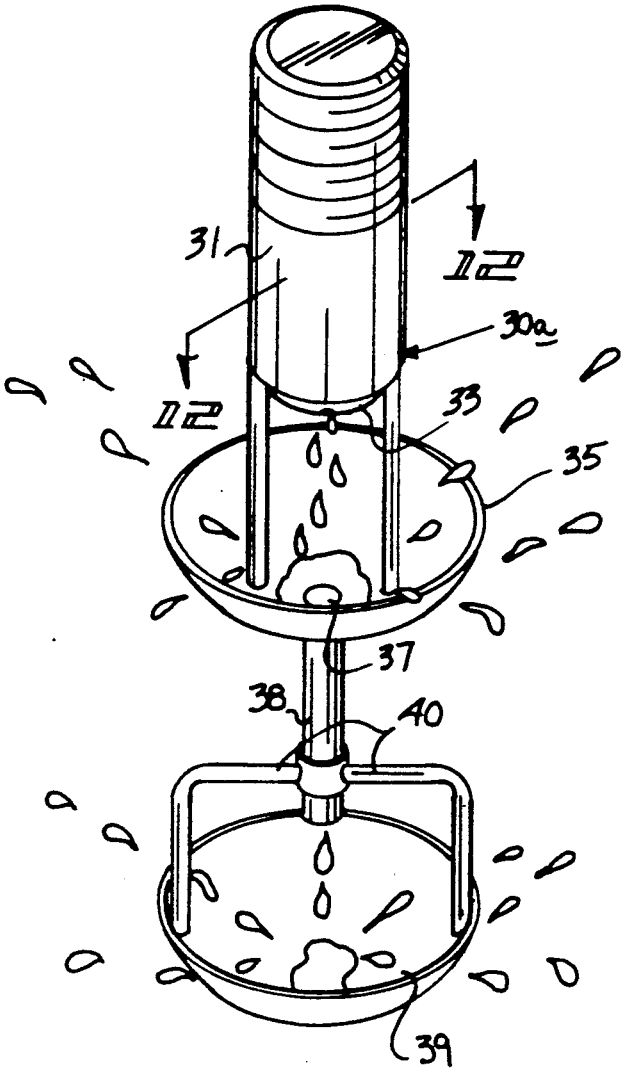
Fig 11
Fig 12
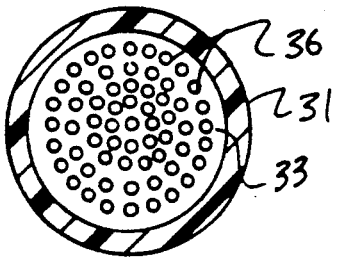

WATER AERATION APPARATUS

BACKGROUND OF THE INVENTION

1. Field of the Invention

The field of invention relates to water reservoir apparatus, and more particularly pertains to a new and improved water aeration apparatus utilizing an approved water reservoir.

2. Description of the Prior Art

Various apparatus has been utilized in the prior art for the aeration and mixing of water. The aeration and mixing of water for use in a waste water situation is exemplified in U.S Pat. No. 4,842,732 to Tharp utilizing a plurality of aerators arranged in a predetermined pattern on a basin floor receiving waste water therewithin to direct air bubbles into the waste water.

U.S. Pat. No. 4,943,305 to Bernardt sets forth an aerating apparatus for expelling of impurities from ground water.

U.S. Pat. No. 4,130,612 to Wilop sets forth an aerator for use in a waste water organization utilizing interleaved sets of upper and lower sectors effected by radially extending webs to enhance aeration in vegetation within a water body.

As such, it may be appreciated that there continues to be a need for a new and improved water aeration apparatus as set forth by the instant invention which addresses both the problems of ease of use as well as effectiveness in construction in the aeration of household water to reduce volume of gas present in water, such as sulphurous gas to thereby minimize unpleasant odor associated with such water and in this respect, the present invention substantially fulfills this need.

SUMMARY OF THE INVENTION

In view of the foregoing disadvantages inherent in the known types of aeration apparatus now present in the prior art, the present invention provides a water aeration apparatus wherein the same is directed to the continuous aeration of a reservoir of water for ultimate consumption. As such, the general purpose of the present invention, which will be described subsequently in greater detail, is to provide a new and improved water aeration apparatus which has all the advantages of the prior art aeration apparatus and none of the disadvantages.

To attain this, the present invention provides a reservoir arranged to receive a water inlet conduit and an upper association with a water outlet conduit. The reservoir includes an aeration manifold effecting aeration of water contained within the reservoir, wherein the aeration manifold cooperates with a water dispersion manifold to enhance aeration of water directed into the reservoir. Various nozzle structure is mounted to the dispersion manifold to enhance aeration in a passive manner in associated with the aeration manifold.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved water aeration apparatus which has all the advantages of the prior art aeration apparatus and none of the disadvantages.

It is another object of the present invention to provide a new and improved water aeration apparatus which may be easily and efficiently manufactured and marketed.

It is a further object of the present invention to provide a new and improved water aeration apparatus which is of a durable and reliable construction.

An even further object of the present invention is to provide a new and improved water aeration apparatus which is susceptible of a low cost of manufacture with regard to both materials and labor, and which accordingly is then susceptible of low prices of sale to the consuming public, thereby making such water aeration apparatus economically available to the buying public.

Still yet another object of the present invention is to provide a new and improved water aeration apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is an orthographic cross-sectional illustration of a conventional conduit pipe utilized by the invention.

FIG. 3 is an orthographic view, taken along the lines 3—3 of FIG. 1 in the direction indicated by the arrows.

FIG. 4 is an orthographic view, taken along the lines 4—4 of FIG. 1 in the direction indicated by the arrows.

FIG. 5 is an isometric illustration of the dispersion head as set forth in Section 5 of FIG. 3.

FIG. 6 is an isometric illustration of a vent head utilized by the instant invention.

FIG. 7 is an isometric view of the vent heads mounted to the instant invention.

FIG. 8 is an isometric illustration of the water dispersion manifold.

FIG. 9 is an orthographic side view, taken in elevation, of a modified water dispersion head utilized by the invention.

FIG. 10 is an orthographic view, taken along the lines 10—10 of FIG. 9 in the direction indicated by the arrows.

FIG. 11 is an isometric illustration of a further modified water dispersion head.

FIG. 12 is an orthographic view, taken along the lines 12—12 of FIG. 11 in the direction indicated by the arrows.

DESCRIPTION OF THE PREFERRED EMBODIMENT

Figure 1:
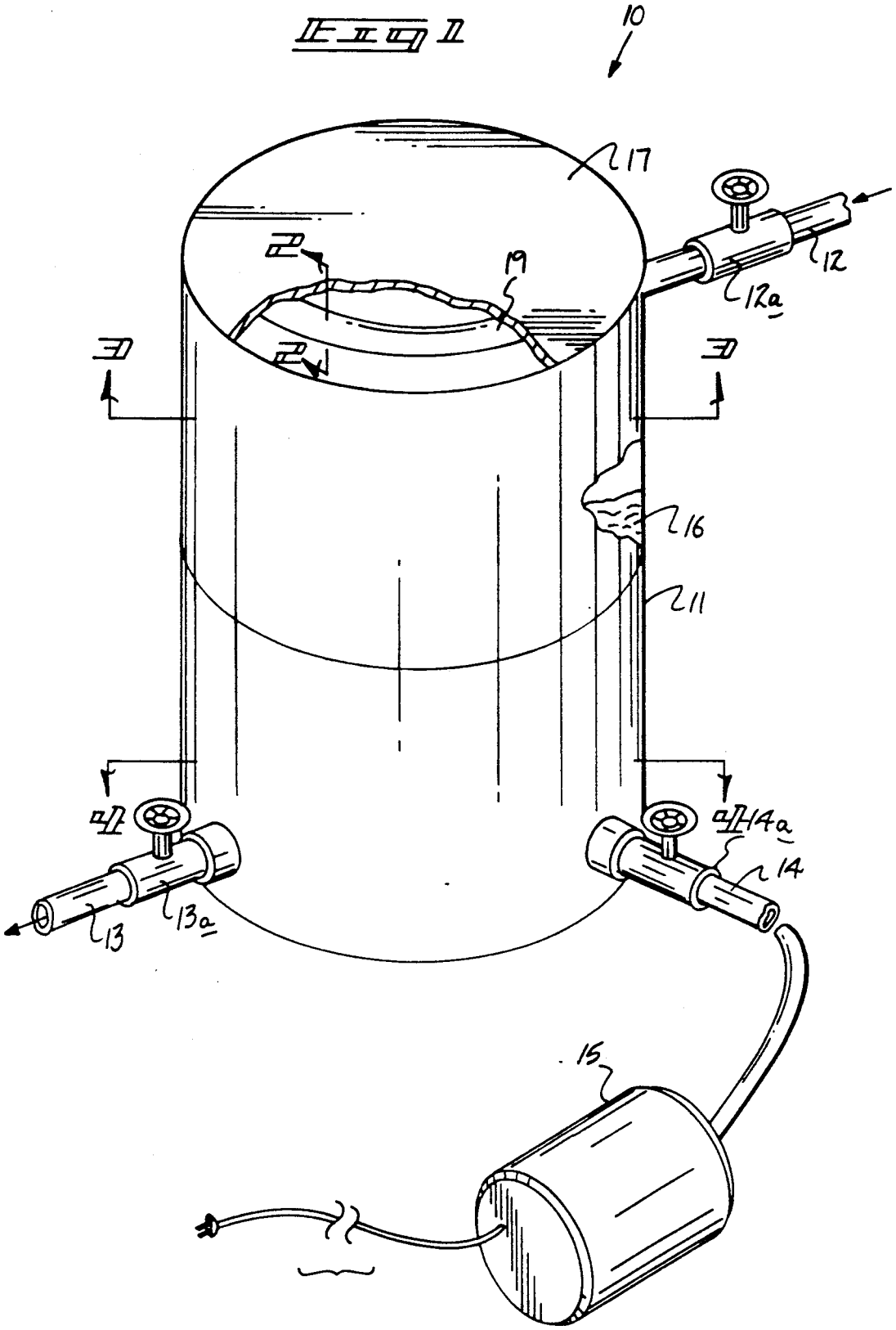
FIG. 1 is an isometric illustration of the instant invention.

With reference now to the drawings, and in particular to FIGS. 1 to 12 thereof, a new and improved water aeration apparatus embodying the principles and concepts of the present invention and generally designated by the reference numeral 10 will be described.

More specifically, the water aeration apparatus 10 of the instant invention essentially comprises a reservoir tank 11 in fluid communication with an inlet conduit 12 directed into the reservoir tank adjacent an upper terminal end of the reservoir tank 11 adjacent the reservoir top wall 17. An outlet conduit 13 positioned adjacent a lower terminal end of the reservoir tank 11 adjacent the bottom wall 18 (see FIG. 4) includes an outlet conduit screen filter 21 contained within the reservoir tank 11 prior to directing water into the outlet conduit 13. The inlet conduit 12 and outlet conduit 13 respectively include respective inlet and outlet conduit valves 12*a* and 13*a* of conventional construction to permit selective fluid flow therethrough. A pneumatic inlet conduit 14 is cooperative with inlet conduit valve 14*a* to direct compressed air from an air compressor 15 into an aeration manifold 20 positioned adjacent the reservoir floor or bottom wall 18. The water dispersion manifold 19 positioned adjacent the reservoir top wall 17 includes a plurality of dispersion heads 22 mounted to a bottom surface of the manifold 19 in confrontation with or above the aeration manifold 20 and the associated bottom wall 18. Each dispersion head 22, such as a type as illustrated in FIG. 5, includes an apertured dispersion head plate 23 to enhance aeration of water flow through each head 22 and directing water into the fluid level 16 of the reservoir, wherein the fluid level 16 is positioned below the top wall 17. The aeration manifold 20 utilizes aeration manifold apertures 24 to direct a source of the pressurized air throughout the fluid 16 contained within the reservoir 16. This results in a directing of air from a plurality of ports from the manifold 20 enhancing the aeration of the water and the removal of the gases such as sulphur dioxide and the like.

If required, vent heads 25 may be mounted to the top wall 17, wherein each vent head includes a screened inlet port 26 in communication with an inlet port conduit 27 directed into the reservoir 17 to direct air flow 29 through the inlet port 26 and an associated inlet port conduit check valve 28 preventing egress of water from the reservoir.

Modified dispersion heads 30 may be utilized throughout the water dispersion manifold 19 to each include a dispersion head conduit tube 31 arranged generally parallel relative to a reservoir axis 11*a* of the associated reservoir 11. The dispersion head conduit tube 31 includes a conduit tube opening 32 directed through a conduit tube face plate 33 that is arranged at a lower terminal end of the conduit tube 31. A plurality of support legs 34 project below the conduit tube 31 mounted to the conduit tube to support a concave dish 35 in confrontation with the opening 32. The concave dish 35 is coaxially aligned relative to the conduit tube 32 in use to effect a splashing of the fluid and enhance duration prior to the water being directed through the reservoir and subject to the aeration through the aeration manifold 20.

A further modified dispersion head 30 utilizes the conduit face plate 33 formed with a matrix of spray apertures 36 to direct fluid onto the concave first dish 35 that is arranged to include a concave dish opening 37 coaxially directed through the concave dish 37 in communication with a concave dish drain tube 38 that is coaxially aligned relative to the concave dish and the dispersion head conduit tube 31. A second concave dish 39 coaxially arranged and spaced below the first concave dish receives a fluid flow thereon to effect a further splashing and aeration of fluid, wherein the second concave dish is mounted by the mounting legs 40 secured as illustrated to the concave dish drain tube 38.

As to the manner of usage and operation of the instant invention, the same should be apparent from the above disclosure, and accordingly no further discussion relative to the manner of usage and operation of the instant invention shal be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Furhter, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A water aeration apparatus, comprising, a reservoir tank, the reservoir tank defined symmetrically about a reservoir axis, including a top wall and a bottom wall, the top wall and bottom wall arranged in a spaced relationship relative to one another, and an inlet conduit directed into the water reservoir tank adjacent the top wall, and an outlet conduit directed into the reservoir tank adjacent the bottom wall, and a pneumatic inlet conduit directed into the reservoir tank adjacent a bottom wall spaced from the outlet conduit, and a water dispersion manifold mounted within the reservoir tank in fluid communication with the inlet conduit to direct fluid into the reservoir tank, and an aeration manifold positioned within the reservoir tank adjacent the bottom wall in pneumatic communication with the pneumatic inlet conduit, the water dispersion manifold including a plurality of dispersion heads mounted into the dispersion manifold, with each dispersion head arranged in confrontation relative to the aeration manifold, and the aeration manifold including a plurality of aeration manifold apertures directed therethrough to direct compressed air into the reservoir tank, and including at least one vent head mounted to the top wall, wherein the vent head includes a screened inlet port directed into the vent head housing, the housing including an inlet port conduit in communication with the inlet port directed into the reservoir tank through the top wall, and a check valve mounted to the inlet port to permit flow of air into the reservoir tank and preventing fluid flow from the reservoir tank through the vent head.

2. An apparatus as set forth in claim 1 wherein each dispersion head includes a conduit tube, the conduit tube of each dispersion head arranged parallel to the reservoir axis, and the conduit tube including a conduit tube face plate, the conduit tube face plate including a matrix of apertures directed therethrough.

3. An apparatus as set forth in claim 2 wherein the conduit tube includes a plurality of support legs mounted fixedly to the conduit tube extending below the conduit tube mounting fixedly a concave dish, the concave dish defining a concave cavity, the concave cavity in confrontation to the conduit tube face plate and coaxially aligned with the conduit tube.

4. An apparatus as set forth in claim 3 wherein the concave dish includes a concave dish central opening, the central opening coaxially aligned relative to the conduit tube and in fluid communication with a concave dish drain tube, the drain tube coaxially aligned relative to the conduit tube and a further concave dish positioned below the concave dish, wherein the further concave dish defines a further concave cavity, the further concave cavity arranged in confrontation to the concave dish spaced therebelow and spaced below a lower terminal end of the drain tube, and mounting means secured to the drain tube for securement of the concave dish in a spaced relationship relative to and below the drain tube, with the further concave dish coaxially aligned relative to the concave dish and the conduit tube.

* * * * *